US011585219B2

(12) United States Patent
Uetake et al.

(10) Patent No.: US 11,585,219 B2
(45) Date of Patent: Feb. 21, 2023

(54) MINING SYSTEM

(71) Applicant: Komatsu Ltd., Tokyo (JP)

(72) Inventors: Masaaki Uetake, Tokyo (JP); Yuichi Kodama, Tokyo (JP); Kazunari Kawai, Tokyo (JP); Shinichi Terada, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 17/268,980

(22) PCT Filed: Oct. 30, 2019

(86) PCT No.: PCT/JP2019/042497
§ 371 (c)(1),
(2) Date: Feb. 17, 2021

(87) PCT Pub. No.: WO2020/100586
PCT Pub. Date: May 22, 2020

(65) Prior Publication Data

US 2021/0310354 A1 Oct. 7, 2021

(30) Foreign Application Priority Data

Nov. 14, 2018 (JP) ..... JP2018-213908

(51) Int. Cl.
*E21F 13/02* (2006.01)
*E21F 13/06* (2006.01)
*E21D 9/14* (2006.01)

(52) U.S. Cl.
CPC ..... *E21D 9/14* (2013.01); *E21F 13/025* (2013.01); *E21F 13/063* (2013.01)

(58) Field of Classification Search
CPC ..... E21F 13/025; E21F 13/063
(Continued)

(56) References Cited

U.S. PATENT DOCUMENTS 1,268,557 A * 6/1918 Evans, Jr. ..... B65G 69/30 414/373
1,492,078 A * 4/1924 Levin ..... E21F 13/065 414/373
(Continued)

FOREIGN PATENT DOCUMENTS

DE 2739079 A1 3/1979
FR 2680201 A1 2/1993
(Continued)

OTHER PUBLICATIONS

Fukui Rui et al., "Production analysis of functionally distributed machines for underground mining", International Journal of Mining Science and Technology, Elsevier, Amsterdam, NL, vol. 26, No. 3, Mar. 29, 2016, pp. 477-485. (cited in the Oct. 14, 2021 Search Report issued for EP19885828.4).

*Primary Examiner* — Sunil Singh
(74) *Attorney, Agent, or Firm* — Locke Lord LLP

(57) ABSTRACT

A mining system includes: a first tunnel that reaches a dump site and includes a first road surface; a second tunnel that crosses the first tunnel, reaches a mining site, and includes a second road surface positioned above the first road surface; a frame that includes a lower surface provided above the first road surface of the first tunnel and forming a transport passage between the first road surface and the lower surface and an upper surface forming a work road surface, on which a loading machine operates, together with the second road surface; and a moving vehicle that is capable of traveling on the first road surface and is capable of passing through the transport passage.

14 Claims, 11 Drawing Sheets

(58) Field of Classification Search
USPC ..... 299/64; 414/373
See application file for complete search history.

(56) References Cited

U.S. PATENT DOCUMENTS

| | | | | | |
|---|---|---|---|---|---|
| 1,723,383 | A * | 8/1929 | Smith | E21F 13/065 | 414/787 |
| 1,765,525 | A * | 6/1930 | Davis | E21F 13/065 | 414/373 |
| 2,143,522 | A * | 1/1939 | McCarthy | E21F 13/06 | 414/528 |
| 2,195,544 | A * | 4/1940 | Stahl | E21F 13/065 | 414/373 |
| 3,759,405 | A * | 9/1973 | Barry | B65G 1/0485 | 414/373 |
| 4,392,769 | A * | 7/1983 | Lowery | B65G 65/04 | 414/373 |
| 5,997,100 | A * | 12/1999 | Marshall | E21C 25/58 | 299/12 |
| 7,899,599 | B2 | 3/2011 | Makela et al. | | |
| 2007/0170771 | A1 | 7/2007 | Cavinder et al. | | |
| 2012/0007412 | A1 * | 1/2012 | Zimmerman | E21F 13/025 | 299/64 |
| 2013/0272828 | A1 * | 10/2013 | Andre | B61D 45/005 | 414/373 |
| 2016/0215621 | A1 | 7/2016 | Kodama et al. | | |
| 2016/0229326 | A1 | 8/2016 | Uetake et al. | | |
| 2016/0232622 | A1 | 8/2016 | Kodama et al. | | |

FOREIGN PATENT DOCUMENTS

| | | | |
|---|---|---|---|
| GB | 2258481 | A | 2/1993 |
| JP | 2017-048572 | A | 3/2017 |
| WO | 2015/046599 | A1 | 4/2015 |
| WO | 2015/046601 | A1 | 4/2015 |

* cited by examiner

MINING SYSTEM

TECHNICAL FIELD

The present invention relates to a mining system.

Priority is claimed on Japanese Patent Application No. 2018-213908, filed Nov. 14, 2018, the content of which is incorporated herein by reference.

BACKGROUND ART

Patent Literature 1 discloses a work machine that is used in the tunnel of a mine. This work machine includes a bucket that mines ore. The work machine moves in the tunnel to transport the ore in a state where the work machine holds the ore in the bucket.

Patent Literature 2 discloses a mining system including a loading machine and a transport vehicle that are used in the tunnel of a mine. The loading machine stays at a mining site to mine ore. The transport vehicle travels in the travel passage to transport the ore, which is loaded from the loading machine, to a dump site.

CITATION LIST

Patent Literature

Patent Literature 1

Specification of U.S. Pat. No. 7,899,599

Patent Literature 2

PCT International Publication No. WO2015/046601

SUMMARY OF INVENTION

Technical Problem

Incidentally, various moving vehicles including a transport vehicle for ore travel in the tunnel. On the other hand, a loading machine reciprocates between a mining site and a travel passage in which a moving vehicle travels. For this reason, the loading machine hinders the movement of other moving vehicles in a case where the loading machine is positioned in the travel passage. As a result, a decrease in productivity is caused.

The present invention has been made in consideration of this problem and an object of the present invention is to provide a mining system that can improve productivity.

Solution to Problem

A mining system according to an aspect of the present invention includes: a first tunnel that reaches a dump site and includes a first road surface; a second tunnel that crosses the first tunnel, reaches a mining site, and includes a second road surface positioned above the first road surface; a frame that is provided above the first road surface of the first tunnel and that includes a lower surface forming a transport passage between the first road surface and the lower surface and an upper surface forming a work road surface, on which a loading machine operates, together with the second road surface; and a moving vehicle that is capable of traveling on the first road surface and is capable of passing through the transport passage.

Advantageous Effects of Invention

According to the mining system of the aspect, productivity can be improved.

DESCRIPTION OF EMBODIMENTS

First Embodiment

A first embodiment of the present invention will be described in detail below with reference to FIGS. 1 to 5.

A mining system 100 is used for underground mining for mining ore from the basement of a mine. In the present embodiment, ore is mined by a block caving method.

<Summary of Mining Site>

Figure 1:
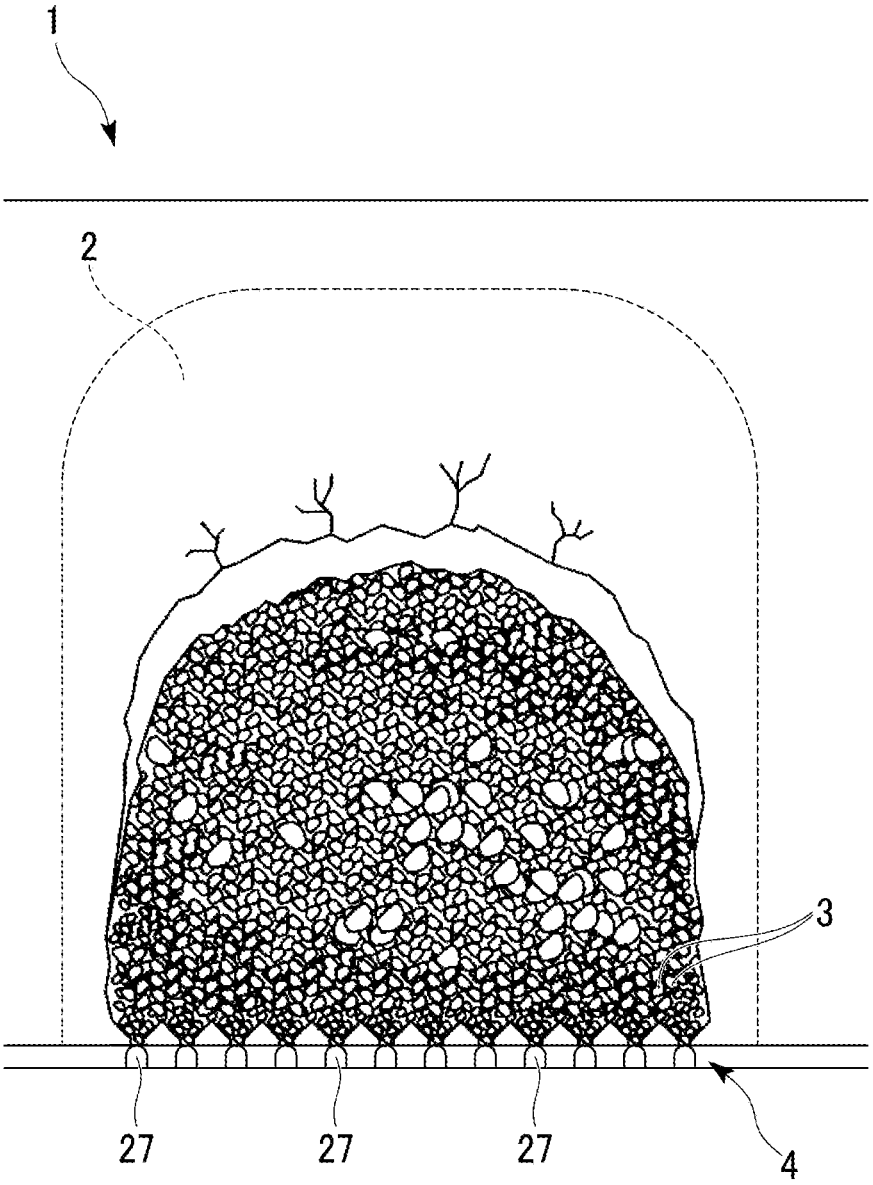
FIG. 1 is a schematic longitudinal sectional view of a mine to which a mining system according to a first embodiment of the present invention is applied.

In a case where ore 3 is mined by a block caving method, a footprint 4 as a tunnel is formed below an ore deposit 2 (ore body) of a mine 1 as shown in FIG. 1. The footprint 4 is a stratum that becomes a production level. Further, holes are formed upward at an undercut level that is a stratum above the production level, and the lower portion of the ore body 2 is blasted (undercut) through the holes. Accordingly, the ore body 2 naturally collapses due to its own weight. Therefore, the ore 3 as a mined material falls on the draw bell of the footprint 4. Areas where the ore 3 falls become mining sites 27. As the ore 3 is mined at the mining sites 27, the natural collapse of the ore body 2 spreads up to the upper portion of the ore body 2. Accordingly, the ore 3 can be continuously mined.

Figure 2:
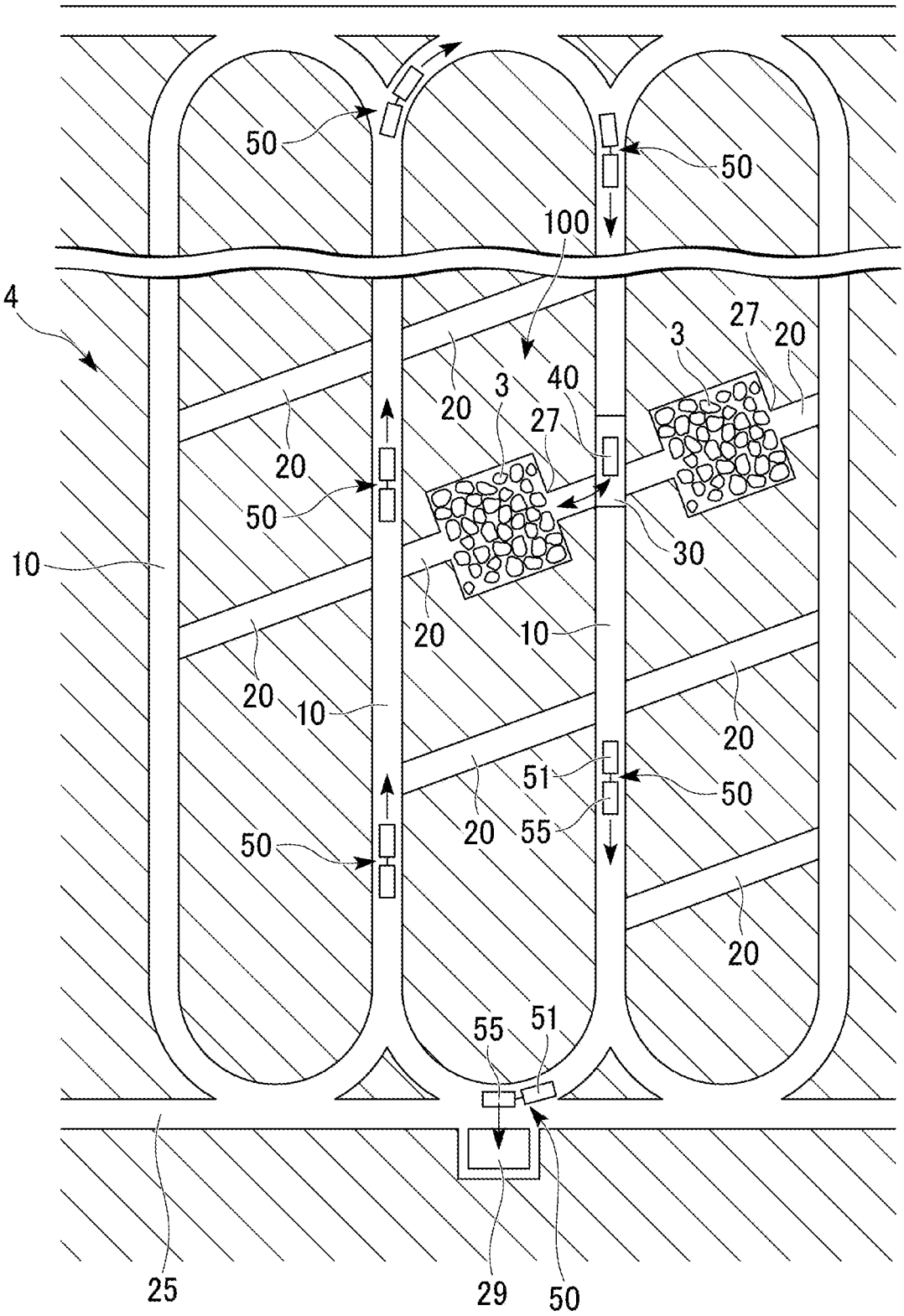
FIG. 2 is a plan view of the footprint of the mine to which the mining system according to the first embodiment of the present invention is applied.

As shown in FIG. 2, the footprint 4 includes drifts 10 (first tunnel), crosscuts 20 (second tunnel), an outer peripheral passages 25 (third tunnel), mining sites 27, and a dump site 29.

The plurality of drifts 10 linearly extend at intervals. In the present embodiment, the plurality of drifts 10 extend in parallel to each other.

The crosscuts 20 extend so as to cross the drifts 10. The crosscuts 20 extend over the drifts 10 adjacent to each other. The plurality of crosscuts 20 are formed at intervals in the extending direction of the drifts 10 between the drifts 10 adjacent to each other.

The outer peripheral passages 25 extend so as to connect the end portions of the plurality of drifts 10. In the present embodiment, the outer peripheral passages 25 extend in a direction orthogonal to the extending direction of the drifts 10. The outer peripheral passages 25 are connected to both ends of the plurality of drifts 10, and the outer peripheral passage 25 may extend in an annular shape so as to surround each drift 10.

Since the end portions of the drifts 10 are bifurcated in a curved shape in plan view in the present embodiment, each drift 10 is smoothly connected to the outer peripheral passage 25. Each drift 10 forms an annular circuit together with the other drift 10 or the outer peripheral passages 25.

The drifts 10, the crosscuts 20, and the outer peripheral passages 25 are formed by a tunnel boring machine.

The mining sites 27 are appropriately provided on the crosscuts 20. The mining sites 27 are formed in a case where the undercut is performed over the entire area at an undercut level that is a stratum above the crosscuts 20 positioned at the production level. Accordingly, the crosscuts 20 are connected to the mining sites 27.

The dump site 29 is provided on the outer peripheral passage 25. A charging hole extending downward is formed in the dump site 29, and the ore 3 can be discharged to the charging hole. The drifts 10 are connected to the dump site 29 through the outer peripheral passages 25.

<Mining System>

The mining system 100 of the present embodiment includes a frame 30, a loading machine 40, and a mined material-transport vehicle 50 as a moving vehicle, in addition to the drifts 10 and the crosscuts 20.

<Drift (First Tunnel)>

Figure 3:
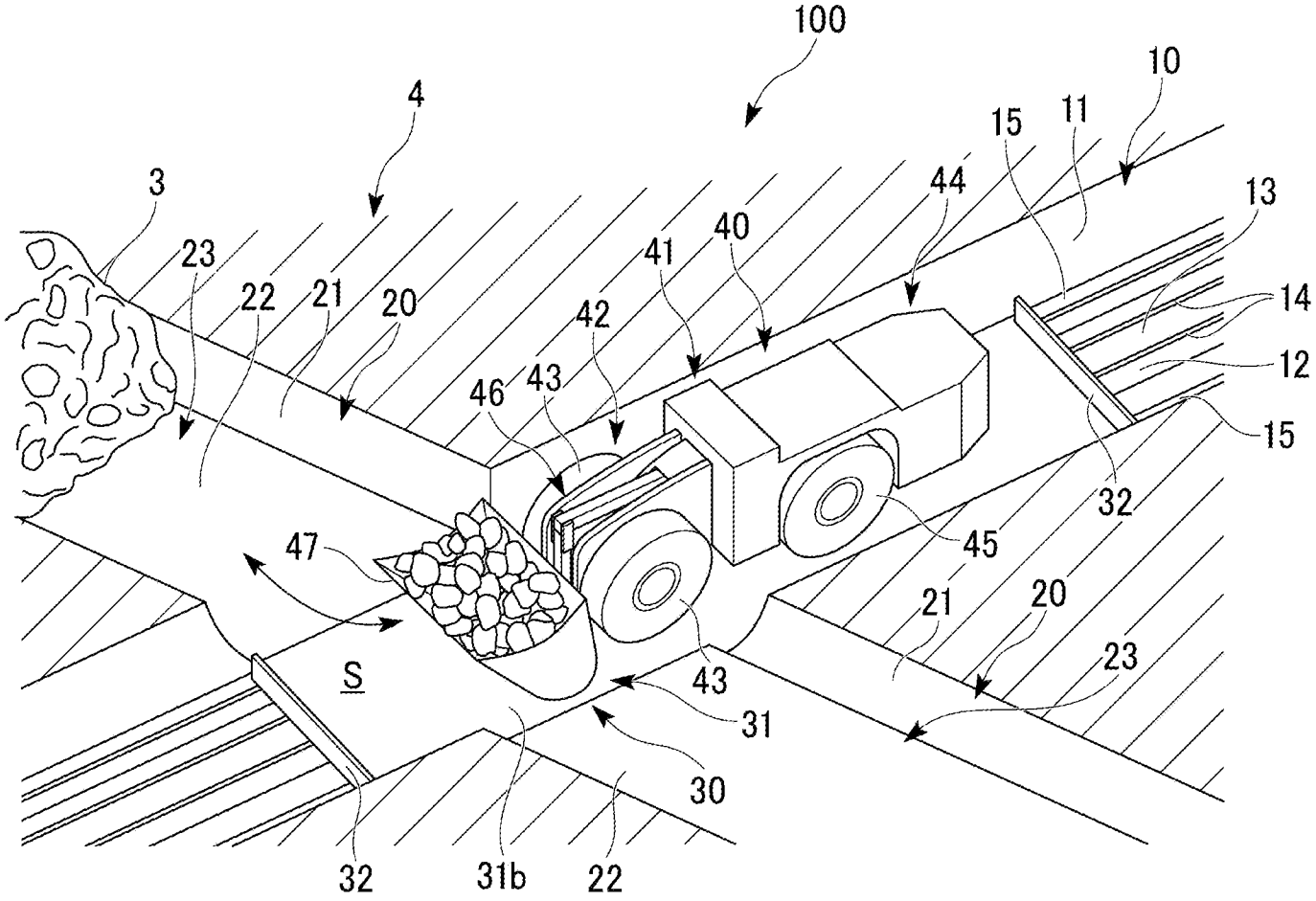
FIG. 3 is a perspective view of a main part of the mining system according to the first embodiment of the present invention.
Figure 4:
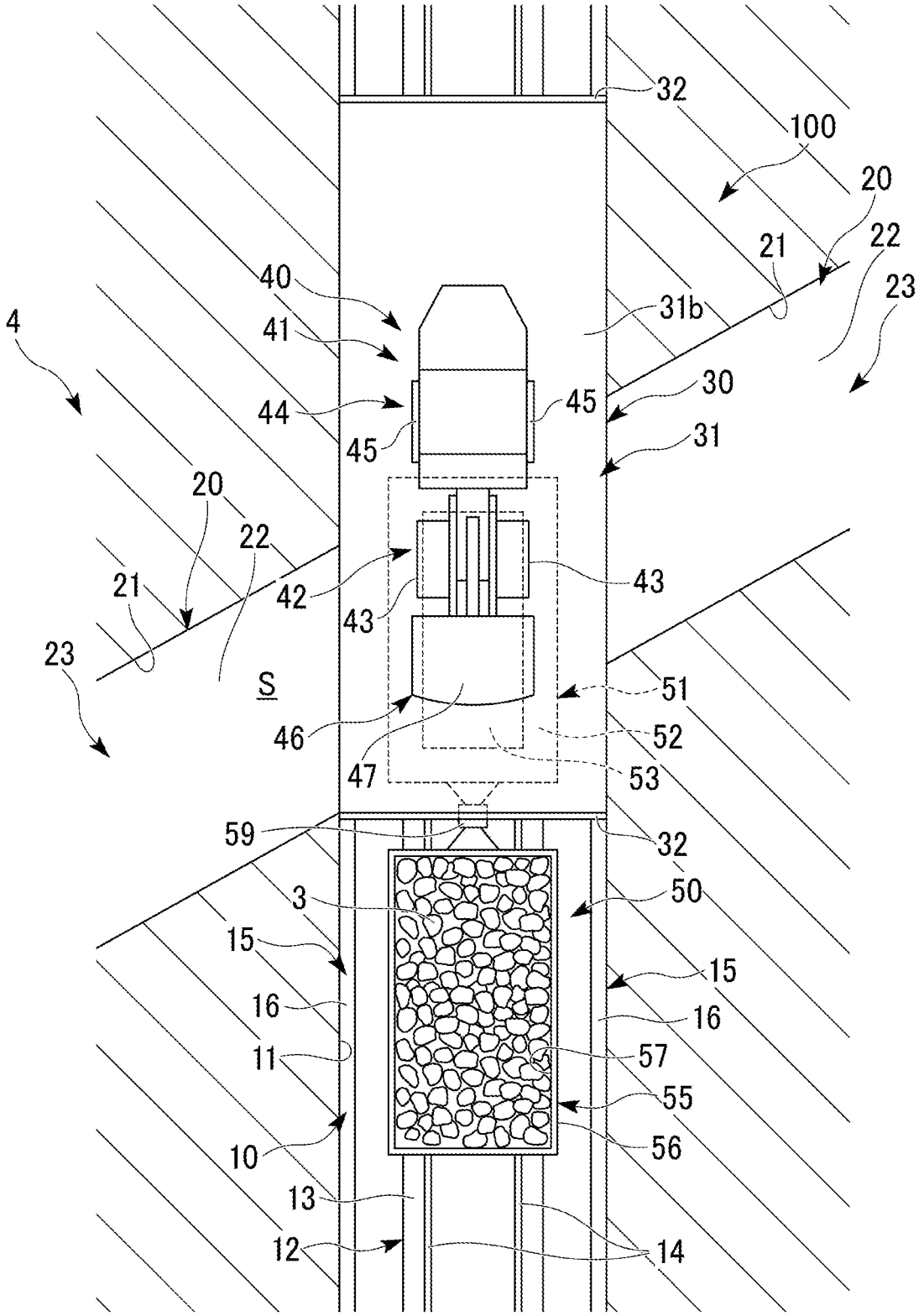
FIG. 4 is a plan view of the main part of the mining system according to the first embodiment of the present invention.
Figure 5:
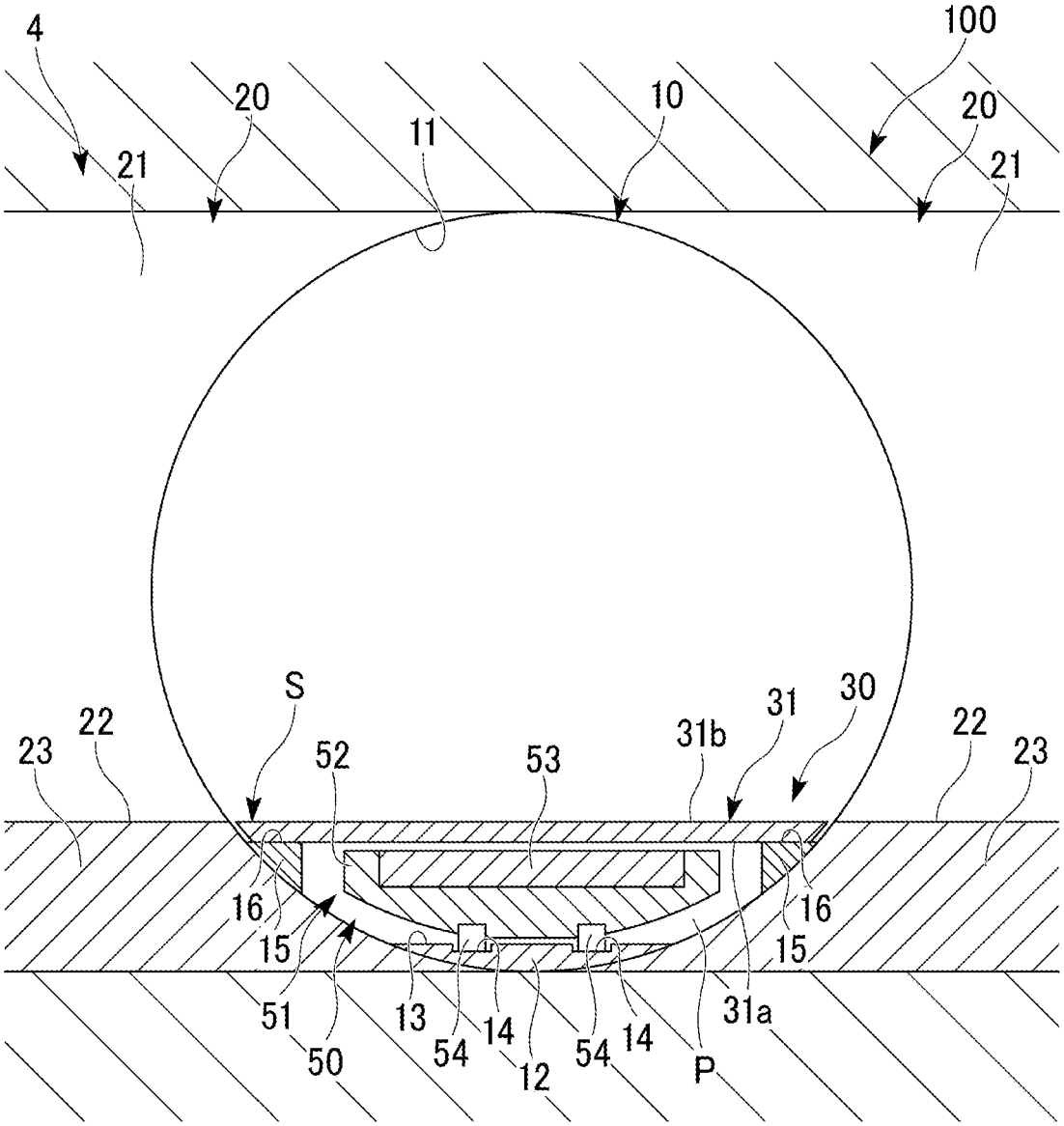
FIG. 5 is a cross-sectional view, which is orthogonal to a drift, of the main part of the mining system according to the first embodiment of the present invention.

In detail, as shown in FIGS. 3 to 5, each drift 10 has an inner peripheral surface 11 having a circular cross-sectional shape and a floor panel 12 and side supports 15 are provided on the inner peripheral surface 11.

The floor panel 12 is a plate-like member that is laid in the extending direction of the drift 10 on the bottom of the inner peripheral surface 11 of the drift 10. The upper surface of the floor panel 12 is a first road surface 13 continuous in the extending direction of the drift 10. The first road surface 13 has a flat shape. A pair of guide grooves 14, which is recessed from the first road surface 13 and extends in the extending direction of the first road surface 13, is formed on the first road surface 13 of the present embodiment. The pair of guide grooves 14 is disposed with an interval therebetween in the width direction of the floor panel 12 and the first road surface 13 (a direction orthogonal to the extending direction of the first road surface 13).

A pair of side supports 15 is provided outside the floor panel 12 in the width direction on the lower portion of the inner peripheral surface 11 of the drift 10. Each side support 15 is disposed with an interval between the floor panel 12 and each side support in the width direction. Like the floor panel 12, the side supports 15 are laid in the extending direction of the drift 10. The upper surface of each side support 15 is a placement surface 16 that extends in a flat shape in the extending direction of the first road surface 13. The height position of the placement surface 16 is located above the height position of the first road surface 13.

<Crosscut (Second Tunnel)>

In detail, as shown in FIGS. 3 to 5, each crosscut 20 is connected to the drift 10 so as to communicate with the drift 10 in the width direction of the first road surface 13. The crosscut 20 has an inner peripheral surface 21 having a circular cross-sectional shape. The inner diameter of the inner peripheral surface 21 of the crosscut 20 is the same as the inner diameter of the inner peripheral surface 11 of the drift 10.

A road panel 23 is provided on the lower portion of the inner peripheral surface 21 having a circular cross-sectional shape, so that a second road surface 22 extending in a flat shape in the extending direction of the crosscut 20 is formed. Banking may be performed on the lower portion of the inner peripheral surface 21 so that the second road surface 22 is formed. The second road surface 22 is formed above the first road surface 13, that is, the height position of the second road surface 22 is located above the height position of the first road surface 13. The height position of the second road surface 22 is located above the placement surfaces 16 of the side supports 15 provided in the drift 10. The height position of the second road surface 22 is located below the center of the inner peripheral surface 11 of the drift 10 having a circular cross-sectional shape.

<Frame>

The frame 30 is provided in an area that is a part of the drift 10 and includes a portion connected to the crosscut 20. The frame 30 includes a horizontal plate part 31 (frame body) having the shape of a plate of which the longitudinal direction is the extending direction of the drift 10, the lateral direction is the width direction (a direction orthogonal to the extending direction) of the drift 10, and the plate thickness direction is a vertical direction. A lower plate surface of a pair of plate surfaces of the horizontal plate part 31 is referred to as a lower surface 31*a*. An upper plate surface of the pair of plate surfaces of the horizontal plate part 31 is referred to as an upper surface 31*b*. The upper surface 31*b* and the lower surface 31*a* extend along a horizontal plane in parallel to each other.

Both side portions of the lower surface 31*a* of the horizontal plate part 31 in the width direction are placed so as to be in contact with the placement surfaces 16 from above over the entire area in the extending direction of the horizontal plate part 31. Accordingly, the horizontal plate part 31 is disposed above the first road surface 13 at interval with respect to the first road surface 13. That is, a space is partitioned and formed between the lower surface 31*a* of the horizontal plate part 31 and the first road surface 13. The space is a transport passage P that extends in the extending direction of the first road surface 13 below the horizontal plate part 31.

The height position of the upper surface 31*b* of the horizontal plate part 31 is a position corresponding to the height position of the second road surface 22. In the present embodiment, the height position of the upper surface 31*b* of the horizontal plate part 31 is the same as the height position of the second road surface 22. A work road surface S continuously extending over the upper surface 31*b* and the second road surface 22 is formed by the upper surface 31*b* of the horizontal plate part 31 and the second road surface 22. The height position of the upper surface 31*b* of the horizontal plate part 31 and the height position of the second road surface 22 may be slightly shifted from each other. These height positions may be different from each other as long as a loading machine 40 to be described later passes over a connection portion between the upper surface 31*b* of the horizontal plate part 31 and the second road surface 22. That is, a difference between the height position of the upper surface 31*b* of the horizontal plate part 31 and the height position of the second road surface 22 is allowed as long as the loading machine 40 is capable of moving on the work road surface S over the horizontal plate part 31 and the second road surface 22.

The upper surface 31*b* of the horizontal plate part 31 and the second road surface 22 are continued to be flush with each other in the present embodiment, but some gaps may be present between these. The dimensions of the gaps are allowed as long as the loading machine 40 can move on the work road surface over the upper surface 31*b* of the horizontal plate part 31 and the second road surface 22.

Stoppers 32 are provided at both end portions of the upper surface 31*b* of the horizontal plate part 31 in the extending direction (longitudinal direction) of the horizontal plate part 31, respectively. The pair of stoppers 32 protrudes from the upper surface 31*b* at both end portions of the horizontal plate part 31 and extends in the width direction (lateral direction) of the horizontal plate part 31.

<Loading Machine>

As shown in FIG. 3, the loading machine 40 is a so-called load-haul-dump machine. The loading machine 40 operates over the upper surface 31*b* and the second road surface 22 in a state where the upper surface 31*b* of the horizontal plate part 31 and the second road surface 22 serve as the work road surface S. The loading machine 40 is capable of being operated autonomously by a command that is output from a management device (not shown) through wireless communication. The loading machine 40 includes a vehicle body 41 and work equipment 46.

The vehicle body 41 includes a front vehicle body 42 and a rear vehicle body 44, and the front vehicle body 42 and the rear vehicle body 44, which are adapted to be capable of moving forward and backward, are arranged side by side in a forward/backward direction. The front vehicle body 42 includes a pair of front wheels 43 that is disposed with an interval therebetween in the vehicle width direction of the vehicle body 41. The rear vehicle body 44 includes a pair of rear wheels 45 that is disposed with an interval therebetween in the vehicle width direction of the vehicle body 41. In a case where the front wheels 43 and the rear wheels 45 are driven by a travel motor (not shown), the vehicle body 41 moves forward and backward. Electric power may be supplied to the travel motor through a battery and an inverter provided in the vehicle body 41, or electric power may be supplied to the travel motor through a cable and an inverter (not shown). Electric power may be supplied to the battery from rails laid on the first road surface 13 in a contactless manner.

The front vehicle body 42 and the rear vehicle body 44 are connected to each other so as to be rotatable relative to each other. That is, the front vehicle body 42 and the rear vehicle body 44 have articulated structure where the front vehicle body 42 and the rear vehicle body 44 can be bent in a horizontal direction at a connection portion therebetween as a joint.

The swing of the vehicle body 41 is performed by the drive of a steering cylinder. Hydraulic oil is supplied to the steering cylinder through a hydraulic pump and a hydraulic valve. The hydraulic pump is driven by a motor for hydraulic pressure. Electric power may be supplied to the motor for hydraulic pressure through the battery and inverter provided in the vehicle body 41, or electric power may be supplied to the motor for hydraulic pressure through a cable and an inverter (not shown).

The work equipment 46 is provided at the front vehicle body 42. The work equipment 46 extends further forward from the front vehicle body 42. The work equipment 46 includes a bucket 47 that mines and is capable of accommodating the ore 3 of the mining site 27. In a case where the work equipment 46 is driven, the mining of the ore 3 and the loading of the ore 3 in the mined material-transport vehicle 50 to be described later are performed. The work equipment 46 is driven by a hydraulic cylinder (not shown).

<Mined Material-Transport Vehicle>

As shown in FIGS. 4 and 5, the mined material-transport vehicle 50 is adapted to be capable of traveling on the first road surface 13 in the extending direction of the first road surface 13 and to be capable of accommodating the ore 3. The mined material-transport vehicle 50 of the present embodiment includes a driving vehicle 51, a loading vehicle 55, and a connection unit 59.

The driving vehicle 51 can self-travel on the first road surface 13 by a command that is output from the management device (not shown) through wireless communication. As shown in FIG. 5, the driving vehicle 51 includes a vehicle body 52, rollers 54, and a drive unit 53.

The vehicle body 52 has a rectangular shape of which the longitudinal direction is the extending direction of the drift 10 and the lateral direction is the width direction in plan view. The length of the vehicle body 52 in the longitudinal direction (the front/rear direction of the vehicle body 52) is sufficiently smaller than the dimension of the horizontal plate part 31 of the frame 30 in the longitudinal direction. The length of the vehicle body 52 in the lateral direction (the width direction of the vehicle body 52) is smaller than the interval between the pair of side supports 15. The thickness of the vehicle body 52 in the vertical direction is smaller than a distance between the first road surface 13 and the lower surface 31*a* of the frame 30 facing each other. Accordingly, the vehicle body 52 is capable of being accommodated in the transport passage P.

The rollers 54 are supported by the lower surface of the vehicle body 52. A pair of rollers 54 is provided with an interval therebetween in the width direction of the vehicle body 52. The lower portions of the pair of rollers 54 are accommodated in the guide grooves 14, respectively. A plurality of pairs of rollers 54 are provided at intervals in the front/rear direction of the vehicle body 52. Each roller 54 is rotatable about an axis extending in the width direction of the vehicle body 52.

The drive unit 53 is built in the vehicle body 52. The drive unit 53 includes the battery, the inverter, the travel motor (not shown), and the like. Electric power supplied from the battery is supplied to the travel motor through the inverter, so that the travel motor is rotationally driven. The rollers 54 are rotated as the travel motor is rotationally driven. The rollers 54 are rotated in the guide grooves 14. Thereby, the driving vehicle 51 is moved in the extending direction of the guide grooves 14.

As shown in FIG. 4, the loading vehicle 55 is capable of being loaded with the ore 3 and is capable of traveling on the first road surface 13 using the power of the driving vehicle 51. The loading vehicle 55 includes a vehicle body 56 and rollers (not shown). The vehicle body 56 and the rollers have the same configuration as the vehicle body 52 and the rollers 54 of the driving vehicle 51. An accommodating portion 57 recessed from the upper surface of the vehicle body 56 over the entire upper surface is formed in the vehicle body 56 of the loading vehicle 55. The ore 3 is accommodated in the accommodating portion 57. The loading vehicle 55 is disposed adjacent to the driving vehicle 51 in the extending direction of the first road surface 13.

The connection unit 59 connects the driving vehicle 51 to the loading vehicle 55. The connection unit 59 is provided between the driving vehicle 51 and the loading vehicle 55. The connection unit 59 is adapted to allow the driving vehicle 51 and the loading vehicle 55 to be attachably and detachably connected to each other by, for example, the supply of current to an electromagnet or the cutoff thereof.

<Effects>

In a case where ore 3 is to be mined by the mining system 100 having the above-mentioned configuration, the loading machine 40 enters the crosscut 20 from the drift 10 and mines the ore 3 of the mining site 27 by the bucket 47. Then, the loading machine 40 moves to the upper surface 31*b* of the frame 30 as shown in FIG. 3 by swinging while moving backward in a state where the ore 3 is accommodated in the bucket 47. In this case, since the stoppers 32 are present on the front and rear sides of the frame 30, it is possible to avoid that the loading machine 40 carelessly falls from the frame 30.

The mined material-transport vehicle 50 travels on the first road surface 13 of the circuit including the drifts 10. In this case, the mined material-transport vehicle 50 travels on the first road surface 13 while passing through the transport passage P as a tunnel. That is, the mined material-transport vehicle 50 is capable of passing below the frame 30 without being hindered by the frame 30 provided in the drift 10. A plurality of the mined material-transport vehicles 50 are operated at the same time as shown in FIG. 2.

In a case where the ore 3 is to be loaded in the mined material-transport vehicle 50, the loading vehicle 55 of the mined material-transport vehicle 50 is disposed at a loading position as shown in FIG. 4. The loading position is a position where the loading vehicle 55 is exposed from the end portion of the frame 30 positioned on the bucket 47 side of the loading machine 40 in the extending direction of the first road surface 13 in plan view. In the present embodiment, the driving vehicle 51 at the loading position is positioned below the frame 30, that is, in the transport passage P.

Then, in a state where the mined material-transport vehicle 50 is disposed at the loading position, the ore 3 is loaded so as to fall into the accommodating portion 57 of the loading vehicle 55 from the bucket 47 of the loading machine 40. The loading machine 40 mines ore 3 at the mining site 27 and loads the ore 3 in the loading vehicle 55 multiple times while reciprocating on the upper surface 31*b* of the frame 30 and the second road surface 22 as the work road surface S.

In a case where the amount of the ore 3 loaded in the loading vehicle 55 is sufficient, the mined material-transport vehicle 50 travels in the drift 10 toward the dump site 29. Then, the mined material-transport vehicle 50 discharges the ore 3 at the dump site 29. In a case where the ore 3 is discharged to the dump site 29, the connection between the driving vehicle 51 and the transport vehicle using the connection unit 59 may be released. Further, a device for lifting up the transport vehicle to discharge ore 3 may be provided at the dump site 29.

In a case where the mined material-transport vehicle 50 transports the ore 3 to the dump site 29, the other mined material-transport vehicle 50 moves to the loading position and is loaded with the ore 3 by the loading machine 40. The mined material-transport vehicle 50 having discharged the ore 3 to the dump site 29 travels in the circuit as shown in FIG. 2 to move to a loading site and is loaded with ore 3 again. Accordingly, the continuous mining and transport of ore 3 arc performed.

According to the mining system 100 of the present embodiment, since the lower portion of the drift 10 is used as the transport passage P of the mined material-transport vehicle 50 as described above, a space in the tunnel can be effectively used. Further, mining and transport can be efficiently performed without interference between the travel of the mined material-transport vehicle 50 and the operation of the loading machine 40.

Furthermore, since the loading machine 40 and the mined material-transport vehicle 50 are used, the loading machine 40 can be used exclusively for the mining and loading of ore 3 only on the work road surface S. Moreover, since the plurality of mined material-transport vehicles 50 are caused to travel at the same time, the loading machine 40 can operate continuously without waiting time. For this reason, productivity can be improved.

In addition, since the mined material-transport vehicle 50 is positioned below the upper surface 31*b* of the frame 30 on which the loading machine 40 is positioned, a loading height is not restricted by the cross-sectional shape of the drift 10 or the size of the loading machine 40 and work for loading ore 3 can be smoothly performed.

Second Embodiment

Figure 6:
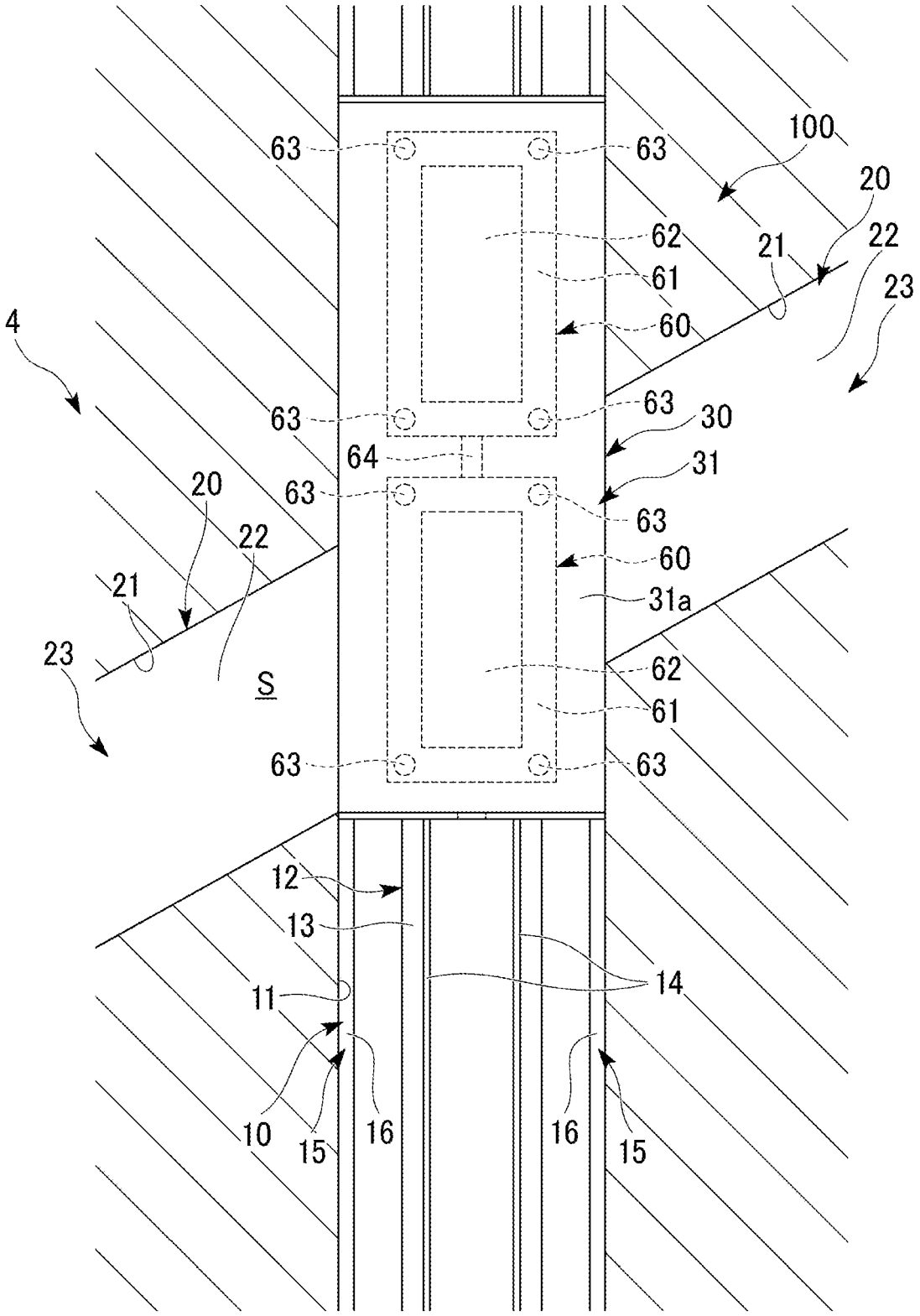
FIG. 6 is a plan view showing frame transport vehicles of a mining system according to a second embodiment of the present invention.
Figure 7:
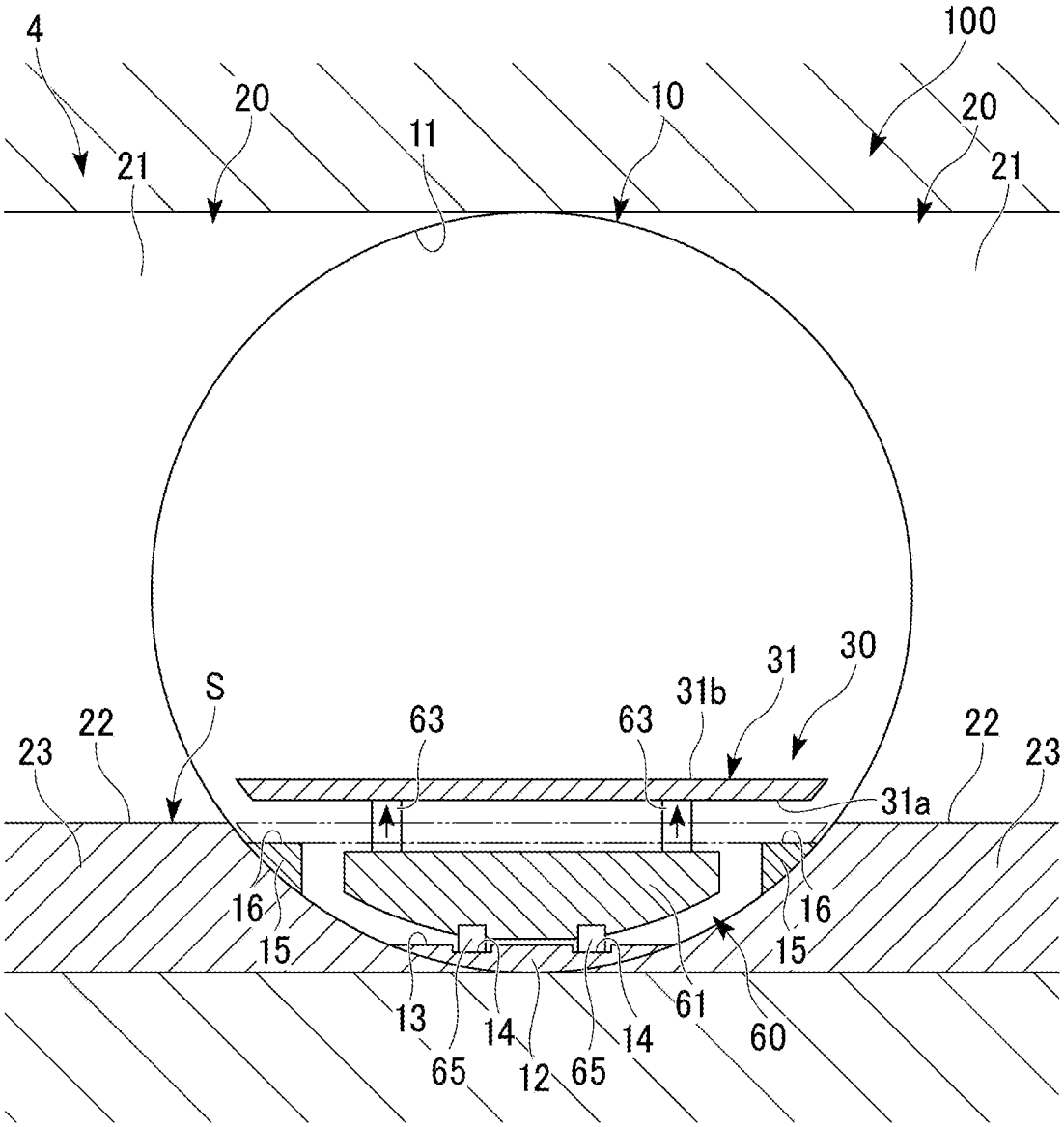
FIG. 7 is a cross-sectional view, which is orthogonal to a drift, showing the frame transport vehicle of the mining system according to the second embodiment of the present invention.

Next, a second embodiment of the present invention will be described with reference to FIGS. 6 and 7. In the second embodiment, the same components as those of the first embodiment are denoted by the same reference numerals as those of the first embodiment and the detailed description thereof will be omitted.

The second embodiment is different from the first embodiment in that a mining system includes frame transport vehicles 60 as a moving vehicle.

Each frame transport vehicle 60 includes a vehicle body 61, a drive unit 62, rollers 65, a connection unit 64, and lifting units 63. The vehicle body 61, the drive unit 62, and the rollers 65 have the same configuration as the vehicle body 52, the drive unit 53, and the rollers 54 of the driving vehicle 51 of the first embodiment. Two frame transport vehicles 60 of the present embodiment are provided with an interval therebetween in the extending direction of the first road surface 13, and each of the frame transport vehicles 60 is provided with a drive unit 62 and rollers 65. The two vehicle bodies 61 are connected to each other by the connection unit 64.

The lifting units 63 are provided at four corners of each vehicle body 61 in plan view. The lifting unit 63 of the present embodiment is a lift-up cylinder that is capable of protruding from the upper surface of the vehicle body 61. In normal times, the lift-up cylinders are accommodated in the vehicle body 61 in a state where the lift-up cylinders retract without protruding from the upper surface of the vehicle body 61. The lifting units 63 are driven so as to protrude upward from the upper surface of the vehicle body 61 by a command that is output from a management device through wireless communication. For example, the lift-up cylinder may be adapted to be driven by the supply of electric power from a battery of the drive unit 62 or may be adapted to be driven by hydraulic pressure. The plurality of lift-up cylinders are adapted to protrude and retract in synchronization.

<Effects>

The frame transport vehicles 60 can transport the frame 30 in a state where the loading machine 40 is placed on the frame 30. In a case where the frame transport vehicles 60 transport the frame 30, the frame transport vehicles 60 moves through the transport passage P. Then, the frame transport vehicles 60 cause the lift-up cylinders, which retract and sink in the vehicle body 61, to protrude upward. Accordingly, since the lower surface 31*a* of the frame 30 is lifted up, the frame 30 floats from the placement surfaces 16 of the side supports 15. That is, the frame 30 is changed into a transport state where the frame 30 is lifted up by the lift-up cylinders from a placement state where the frame 30 is placed on the placement surfaces 16.

Since the frame transport vehicles 60 travel in a state where the frame 30 is lifted up by the lift-up cylinder, the frame transport vehicles 60 can transport the frame 30 to an arbitrary site. Then, the lift-up cylinders retract downward, so that the frame 30 can be placed at an arbitrary site.

Accordingly, the frame 30 can be installed at a connection portion between the drift 10 and the other crosscut 20 from a connection portion between the drift 10 and the crosscut 20 where the frame 30 is provided originally. Therefore, since the frame 30 and the loading machine 40 can be transferred to a new mining site 27, mining from a mining site 27 can be efficiently performed at each mining site.

Third Embodiment

Figure 8:
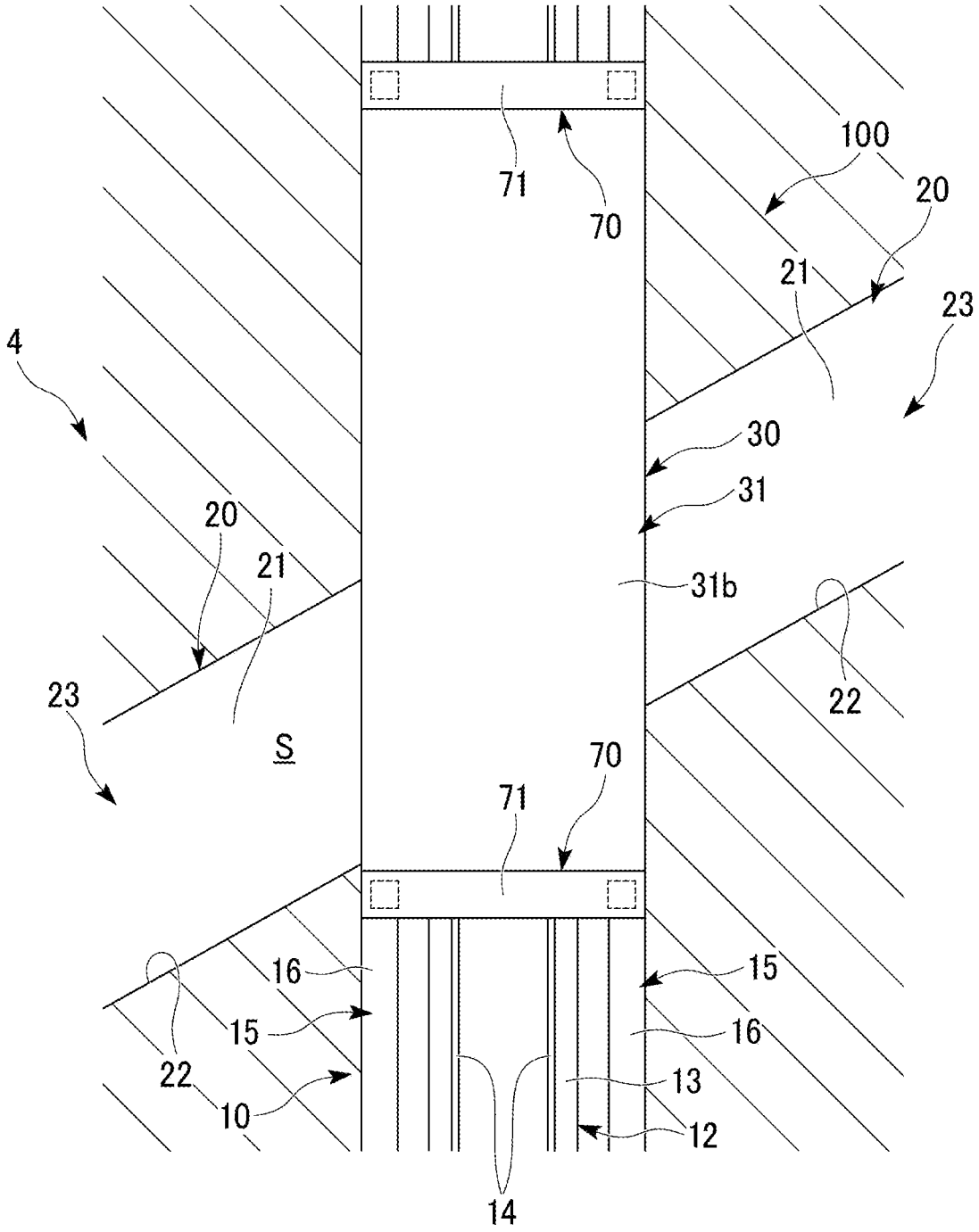
FIG. 8 is a plan view of a main part of a mining system according to a third embodiment of the present invention.

Next, a third embodiment of the present invention will be described with reference to FIGS. 8 and 10. In the third embodiment, the same components as those of the first embodiment are denoted by the same reference numerals as those of the first embodiment and the detailed description thereof will be omitted.

The third embodiment is different from the first embodiment in that a mining system includes self-traveling units 70 for the frame 30.

The self-traveling units 70 are for causing the frame 30 to self-travel and are provided at both ends of the horizontal plate part 31 of the frame 30 in the longitudinal direction.

Each self-traveling unit 70 includes a Self-traveling unit body 71, roller support parts 75, a hydraulic pressure supply part 77, rollers 76, and a roller drive unit 78.

The self-traveling units 70 are integrally fixed to both end faces of the horizontal plate part 31 of the frame 30 in the longitudinal direction, respectively. The self-traveling units 70 extend in the width direction of the horizontal plate part 31.

Figure 9:
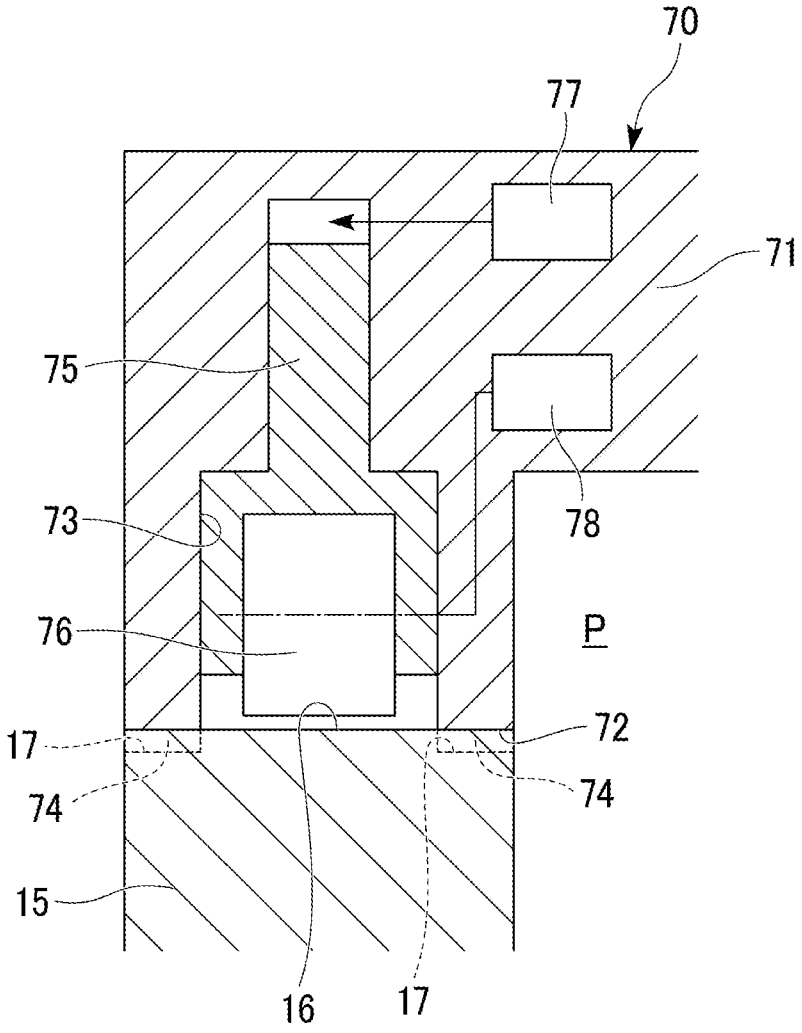
FIG. 9 is a cross-sectional view, which includes a width direction, of a main part of a Self-traveling unit body of the mining system according to the third embodiment of the present invention.

As shown in FIG. 9, side lower surfaces 72, which are lower surfaces of both side portions of the self-traveling unit 70 in the width direction, are side lower surfaces 72 placed on the placement surfaces 16 of the side supports 15. An accommodating recess 73 is formed on each side lower surface 72 so as to be recessed upward. Each self-traveling unit 70 is provided with a pair of accommodating recesses 73 in the width direction.

Engagement protrusions 74 are formed on both sides of an opening of each of the accommodating recesses 73 of the side lower surfaces 72 in the width direction. The engagement protrusions 74 are formed so as to protrude downward from the side lower surface 72. Locking holes 17 into which the engagement protrusions 74 are inserted from above are formed on the placement surface 16 of each side support 15. Since the engagement protrusions 74 are inserted into the locking holes 17, the movement of the frame 30 in the horizontal direction, particularly, the movement of the frame 30 in the extending direction of the first road surface 13 is restricted.

The roller support part 75 is accommodated in each accommodating recess 73. The roller support part 75 is provided so as to be movable in the vertical direction in the accommodating recess 73. Hydraulic oil is supplied to a closed space that is partitioned and formed by the bottom of the accommodating recess 73 and the upper end of the roller support part 75. Hydraulic oil is supplied by the hydraulic pressure supply part 77 provided in the self-traveling unit 70. The hydraulic pressure supply part 77 is adapted to be capable of supplying/discharging hydraulic oil to/from the closed space.

The rollers 76 are supported under the roller support parts 75. The rollers 76 are rotatable about an axis extending in the width direction.

As shown in FIG. 9, the lower end of the roller 76 is positioned above the side lower surface 72 and is accommodated in the accommodation space in a state where hydraulic oil is not supplied to the closed space, that is, a state where hydraulic oil is discharged from the closed space. This state is the placement state of the self-traveling units 70 and the frame 30.

Figure 10:
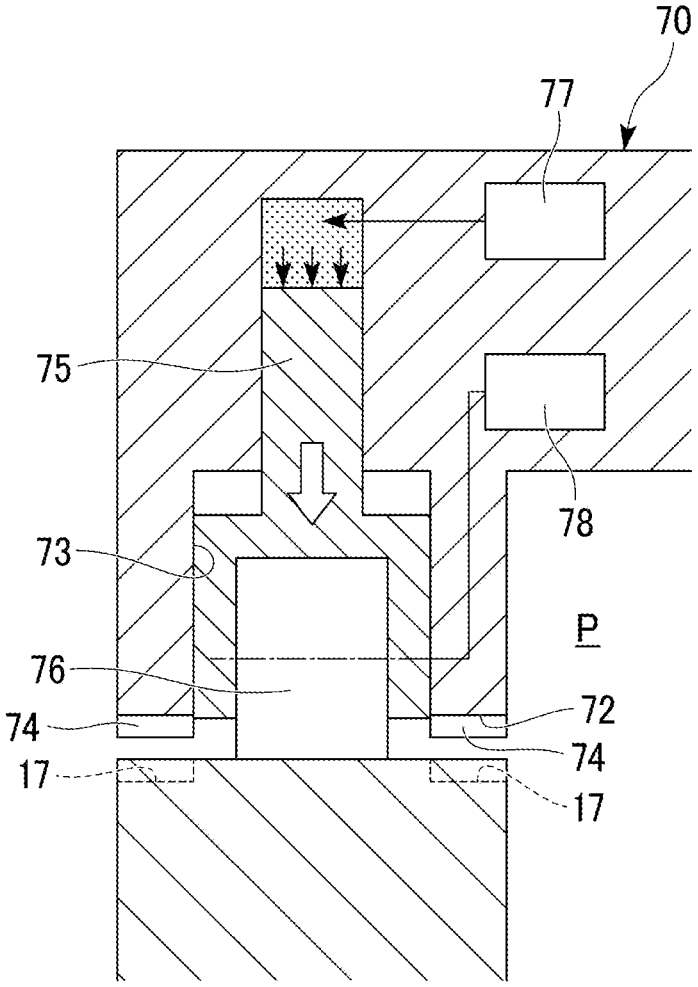
FIG. 10 is a cross-sectional view, which includes a width direction, of the main part of the Self-traveling unit body of the mining system according to the third embodiment of the present invention.

On the other hand, since the hydraulic oil presses the upper end of the roller support part 75 downward as shown in FIG. 10 in a case where hydraulic oil is supplied to the closed space, the roller support part 75 is moved downward. As a result, the lower surface of the roller 76 is in contact with the placement surface 16, and the side lower surface 72 is separated upward from the placement surface 16 so that the engagement protrusions 74 are disengaged from the locking holes 17. Accordingly, each self-traveling unit body 71 is in a state where the self-traveling unit body 71 floats from the placement surfaces 16, and the frame 30 integrally fixed to the self-traveling unit bodies 71 is also in a state where the frame 30 floats from the placement surfaces 16 likewise. This state is the movable state of the self-traveling units 70 and the frame 30.

The rollers 76 is capable of being rotationally driven by the roller drive unit 78 built in the self-traveling unit body 71. In a case where the self-traveling units 70 and the frame 30 are in the movable state as described above and the rollers 76 are rotated, the self-traveling units 70 and the frame 30 can be moved to an arbitrary portion in a state where the loading machine 40 is placed on the frame 30.

Accordingly, since the frame 30 and the loading machine 40 can be transferred to a new mining site 27 as in the second embodiment even in the present embodiment, mining work can be efficiently performed.

Fourth Embodiment

Figure 11:
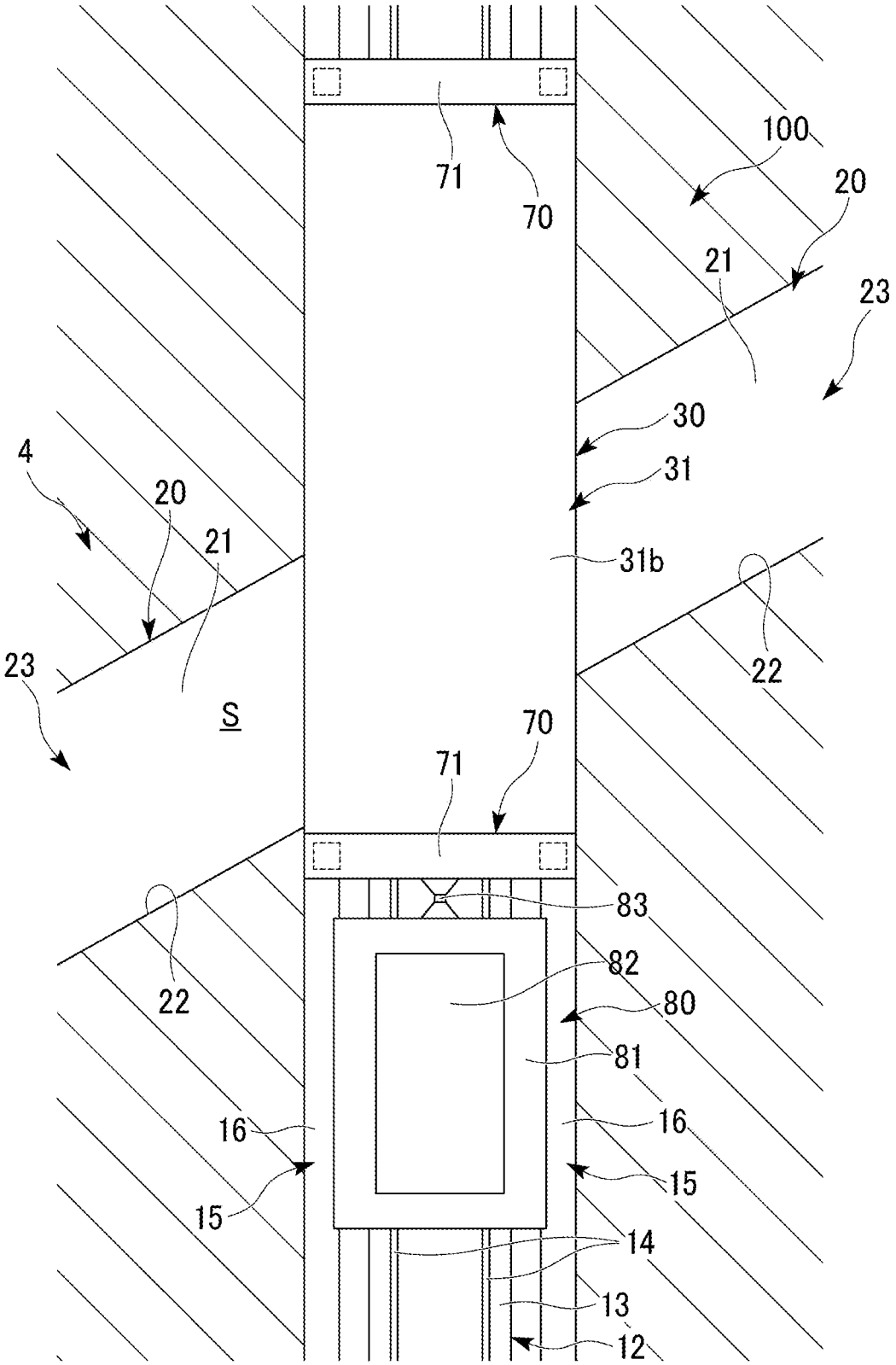
FIG. 11 is a plan view of a main part of a mining system according to a fourth embodiment of the present invention.

Next, a fourth embodiment will be described with reference to FIG. 11. In the fourth embodiment, the same components as those of the third embodiment are denoted by the same reference numerals as those of the third embodiment and the detailed description thereof will be omitted.

The fourth embodiment is different from the third embodiment in that a mining system includes a frame towing vehicle 80.

The frame towing vehicle 80 is adapted to be capable of towing the frame 30, which is in a movable state, for each loading machine placed on the frame 30. The frame towing vehicle 80 includes a vehicle body 81, a drive unit 82, and a connection unit 83. The vehicle body 81 and the drive unit 82 have the same configuration as the vehicle body 52 and the drive unit 53 of the driving vehicle 51 of the mined material-transport vehicle 50. The connection unit 83 allows the vehicle body 81 of the frame towing vehicle 80 and the frame 30 to be attachably and detachably connected to each other like the connection unit 59 of the mined material-transport vehicle 50.

Even in the present embodiment, since the frame towing vehicle 80 self-travels while towing the frame 30 being in a movable state through the connection unit 83, the frame 30 and the loading machine 40 can be transferred to a new mining site 27. In the fourth embodiment, the self-traveling units 70 may not be provided with the roller drive units 78.

Other Embodiments

The embodiments of the present invention have been described above, but the present invention is not limited thereto and can be appropriately modified without departing from the technical idea of the invention.

For example, each moving vehicle has been adapted to travel in the guide grooves 14 of the first road surface 13 in the embodiments, but is not limited thereto. Each moving vehicle may travel on rails laid on the first road surface 13. Further, wheel guides may be formed on the first road surface 13 to guide a moving vehicle.

The loading machine 40 is not limited to a load-haul-dump machine, and various loading machines can be employed. It is preferable that the loading machine is a vehicle having at least an excavation function and a swing function. For example, a telescopic loader including a bucket provided at an end of a telescopic slide arm thereof may be used as the loading machine 40.

An example where each of the connection units 59, 64, and 83 uses an electromagnet attachable and detachable by a magnetic force has been described, but a mechanical connection unit and the like may be used as long as connection and disconnection can be performed.

An example where the cross-sectional shape of the inner peripheral surface 11 of the drift 10 is a circular shape has been described in the embodiments, but the cross-sectional shape of the inner peripheral surface 11 is not limited thereto and may be other shapes, such as an elliptical shape and a polygonal shape. It is preferable that the cross-sectional shape of the inner peripheral surface of the first tunnel is a shape of which the dimension in the width direction is increased toward the upper side between the bottom and a predetermined position.

The loading machine 40 and the moving vehicle are not limited to an electric type, and may be adapted to be capable of traveling using an internal combustion engine, such as a diesel engine.

Cleaning blades, which is capable of removing crushed stones, sand, dust, and the like present on the first road surface 13, may be provided at the end portions of each moving vehicle in the forward/backward direction.

The moving vehicle is not limited to a battery type, and may be adapted to be capable of traveling while electric power is directly supplied from the rails provided on the first road surface 13.

Further, the mined material-transport vehicle 50 may be adapted so that three or more loading vehicles 55 are connected.

Furthermore, the mined material-transport vehicle 50 may include a plurality of driving vehicles 51.

In addition, in the mined material-transport vehicle 50, the driving vehicle 51 may be positioned on the front side of the loading vehicle 55 in the traveling direction. The mined material-transport vehicle 50 can also be used to transport waste in a case where the drifts 10, the crosscuts 20, the outer peripheral passages 25, and the like are formed by a tunnel boring machine.

The block caving method described in the embodiment is a method that is mainly used for hard rock mining, but may be used for soft rock mining to apply the present invention.

Further, in the case of soft rock mining, ore 3 may be mined by a room-and-pillar method. The present invention may be applied thereto.

INDUSTRIAL APPLICABILITY

According to the mining system of the present invention, productivity can be improved.

REFERENCE SIGNS LIST

1 Mine
2 Ore deposit (ore body)
3 Ore
4 Footprint
10 Drift (first tunnel)
11 Inner peripheral surface
12 Floor panel
13 First road surface
14 Guide groove
15 Side support
16 Placement surface
17 Locking hole
20 Crosscut (second tunnel)
21 Inner peripheral surface
22 Second road surface
23 Road panel
25 Outer peripheral passage
27 Mining site
29 Dump site
30 Frame
31 Horizontal plate part (frame body)
**31*a*** Lower surface
**31*b*** Upper surface
32 Stopper
40 Loading machine
41 Vehicle body
42 Front vehicle body
43 Front wheel
44 Rear vehicle body
45 Rear wheel
46 Work equipment
47 Bucket
50 Mined material-transport vehicle (moving vehicle)
51 Driving vehicle
52 Vehicle body
53 Drive unit
54 Roller
55 Loading vehicle
56 Vehicle body
57 Accommodating portion
59 Connection unit
60 Frame transport vehicle (moving vehicle)
61 Vehicle body
62 Drive unit
63 Lifting unit
64 Connection unit
65 Roller
70 Self-traveling unit
71 Self-traveling unit body

72 Side lower surface
73 Accommodating recess
74 Engagement protrusion
75 Roller support part
76 Roller
77 Hydraulic pressure supply part
78 Roller drive unit
80 Frame towing vehicle (transport vehicle)
81 Vehicle body
82 Drive unit
83 Connection unit
100 Mining system
P Transport passage
S Work road surface

The invention claimed is:

1. A mining system comprising:

a first tunnel that reaches a dump site and includes a first road surface;

a second tunnel that crosses the first tunnel, reaches a mining site, and includes a second road surface positioned above the first road surface;

a frame, provided on side supports in an area that is a part of the first tunnel and includes a portion connected to the second tunnel, that is provided above the first road surface of the first tunnel and that includes a lower surface forming a transport passage between the first road surface and the lower surface and an upper surface forming a work road surface, on which a loading machine operates, together with the second road surface; and a first type of moving vehicle that is capable of traveling on the first road surface and is capable of passing through the transport passage, wherein a frame transport vehicle that lifts and is capable of transporting the frame is provided as the first type of moving vehicle.

2. The mining system according to claim 1, wherein a height position of the second road surface of the second tunnel is a position corresponding to a height position of the upper surface of the frame.

3. The mining system according to claim 1, further comprising a mined material-transport vehicle in which a mined material is loaded from the loading machine and which is capable of transporting the mined material is provided as a second type of moving vehicle that is capable of traveling on the first road surface and is capable of passing through the transport passage.

4. The mining system according to claim 1, wherein the frame transport vehicle includes a roller that is provided under the frame and that is capable of traveling on the first road surface, and a roller drive unit that rotationally drives the roller.

5. The mining system according to claim 1, wherein the side supports are provided in a width direction on a lower portion of an inner peripheral surface of the first tunnel.

6. The mining system according to claim 5, wherein the frame transport vehicle is capable of lifting the frame from the side supports and is capable of retracting the frame downward so that the frame can be placed at a site.

7. A mining system comprising:

a first tunnel that reaches a dump site and includes a first road surface;

a second tunnel that crosses the first tunnel, reaches a mining site, and includes a second road surface positioned above the first road surface;

a frame, which is in a movable state and provided on side supports in an area that is a part of the first tunnel and includes a portion connected to the second tunnel, that is provided above the first road surface of the first tunnel and that includes a lower surface forming a transport passage between the first road surface and the lower surface and an upper surface forming a work road surface, on which a loading machine operates, together with the second road surface; and a moving vehicle that is capable of traveling on the first road surface and is capable of passing through the transport passage, wherein a frame towing vehicle that is capable of towing the frame, which is in a movable state, is provided as the moving vehicle.

8. The mining system according to claim 7, wherein the side supports are provided in a width direction on a lower portion of an inner peripheral surface of the first tunnel.

9. The mining system according to claim 7, wherein the frame towing vehicle includes a vehicle body, a drive unit, and a connection unit which allows the vehicle body of the frame towing vehicle and the frame to be attachably and detachably connected to each other; and wherein the frame towing vehicle self-travels while towing the frame being in a movable state through the connection unit, whereby the frame and the loading machine can be transferred to a new mining site.

10. A mining system comprising:

a first tunnel that reaches a dump site and includes a first road surface;

a second tunnel that crosses the first tunnel, reaches a mining site, and includes a second road surface positioned above the first road surface;

a frame, provided on side supports in an area that is a part of the first tunnel and includes a portion connected to the second tunnel, that is provided above the first road surface of the first tunnel and that includes a lower surface forming a transport passage between the first road surface and the lower surface and an upper surface forming a work road surface, on which a loading machine is located and operates, together with the second road surface;

the loading machine that has a bucket and that is capable of being self-travelling on the second road surface and the work road surface, that is capable of mining an ore at the mining site, and that is capable of moving into a loading position with mined ore in the bucket, and a first type of moving vehicle that is capable of traveling on the first road surface and is capable of passing through the transport passage, wherein a frame transport vehicle that lifts and is capable of transporting the frame is provided as the first type of moving vehicle, and whereby the frame transport vehicle is capable of transporting both the frame and the loading machine located on the frame to a new mining site.

11. The mining system according to claim 10, wherein the frame transport vehicle includes a roller that is provided under the frame and that is capable of traveling on the first road surface, and a roller drive unit that rotationally drives the roller.

12. The mining system according to claim 10, further comprising a mined material-transport vehicle which is capable of passing through the transport passage and in which a minded material is loaded from the loading machine is provided as a second type of moving vehicle that is capable of traveling on the first road surface.

13. The mining system according to claim 10, wherein the side supports are provided in a width direction on a lower portion of an inner peripheral surface of the first tunnel.

14. The mining system according to claim 10, wherein the frame transport vehicle is capable of lifting the frame from the side supports and is capable of retracting the frame downward so that the frame can be placed at a site.

* * * * *